US011713921B2

(12) United States Patent
Parsnick

(10) Patent No.: US 11,713,921 B2
(45) Date of Patent: Aug. 1, 2023

(54) SYSTEM AND METHOD FOR THE PRODUCTION OF ARGON IN AN AIR SEPARATION PLANT FACILITY OR ENCLAVE HAVING MULTIPLE CRYOGENIC AIR SEPARATION UNITS

(71) Applicant: David R. Parsnick, Amherst, NY (US)

(72) Inventor: David R. Parsnick, Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 412 days.

(21) Appl. No.: 16/995,035

(22) Filed: Aug. 17, 2020

(65) Prior Publication Data

US 2021/0116175 A1 Apr. 22, 2021

Related U.S. Application Data

(60) Provisional application No. 62/916,300, filed on Oct. 17, 2019.

(51) Int. Cl.
*F25J 3/04* (2006.01)

(52) U.S. Cl.
CPC ..... *F25J 3/04654* (2013.01); *F25J 3/04406* (2013.01); *F25J 3/04624* (2013.01); *F25J 3/04721* (2013.01); *F25J 3/04866* (2013.01); *F25J 2200/04* (2013.01); *F25J 2200/70* (2013.01); *F25J 2200/80* (2013.01); *F25J 2205/66* (2013.01)

(58) Field of Classification Search
CPC .. F25J 3/04654; F25J 3/04406; F25J 3/04624; F25J 3/04672; F25J 3/04721; F25J 3/04866; F25J 2200/04; F25J 2200/54; F25J 2200/70; F25J 2200/80; F25J 2235/58; F25J 2245/58; F25J 2250/02
See application file for complete search history.

(56) References Cited

U.S. PATENT DOCUMENTS

| | | | | |
|---|---|---|---|---|
| 5,114,449 | A | 5/1992 | Agrawal et al. | |
| 5,724,835 | A | 3/1998 | Hine | |
| 5,970,743 | A * | 10/1999 | Herron | F25J 3/04678 62/648 |

FOREIGN PATENT DOCUMENTS

| | | | |
|---|---|---|---|
| CN | 1451603 | A | 10/2003 |
| CN | 1325865 | C | 7/2007 |
| CN | 104501530 | A | 4/2015 |
| DE | 10028866 | A1 | 12/2001 |
| EP | 0473078 | A1 | 4/1992 |
| EP | 0841525 | A2 | 5/1998 |
| EP | 1162423 | A2 | 12/2001 |
| SU | 1553804 | A1 | 3/1990 |

* cited by examiner

*Primary Examiner* — Joseph F Trpisovsky
(74) *Attorney, Agent, or Firm* — Robert J. Hampsch

(57) ABSTRACT

A system and method for argon production in an air separation plant facility or enclave having multiple cryogenic air separation units is provided. The present system and method include a centralized argon refining system disposed within one of the cryogenic air separation units and which is configured to include an argon superstaged or ultra-superstaged column arrangement having one or more argon columns and an argon condenser. Crude argon streams from one or more of the other cryogenic air separation units are directed to the argon superstaged or ultra-superstaged column arrangement of the centralized argon refining process.

9 Claims, 5 Drawing Sheets

SYSTEM AND METHOD FOR THE PRODUCTION OF ARGON IN AN AIR SEPARATION PLANT FACILITY OR ENCLAVE HAVING MULTIPLE CRYOGENIC AIR SEPARATION UNITS

CROSS REFERENCE TO RELATED APPLICATIONS

This application claims the benefit of and priority to U.S. provisional patent application Ser. No. 62/916,300 filed Oct. 17, 2019 the disclosure of which is incorporated by reference herein.

TECHNICAL FIELD

The present invention relates to a system and method for argon production in an air separation plant facility or enclave having multiple cryogenic air separation units.

BACKGROUND

Increasing argon production in an air separation unit has traditionally been accomplished by increasing the number of separation stages in the superstaged or ultra-superstaged argon column arrangement or systems in individual air separation units. Needless to say, there is additional capital costs associated with adding theoretical stages of separation to the argon column systems of an air separation unit as well as other construction and operational risk issues that arise due to the increased overall height of the argon columns and the associated cold boxes. In many situations, the additional capital costs and operational risks associated with by increasing the number of argon separation stages does not yield a meaningful cost-benefit and in some situations may result in no net cost benefit whatsoever.

Moreover, there is often a need develop air separation facilities or enclaves which employ multiple air separation units or air separation trains. Often, these multiple air separation units within an air separation plant facility or enclave are very similar or duplicates of one another which facilitates more cost effective construction of the air separation plant facility or enclave and coldbox shipments.

What is needed, is a means to improve argon production in air separation plant facility or enclave that takes advantage of process duplication without suffering the traditional disadvantages associated with by increasing the number of separation stages in the superstaged or ultra-superstaged argon column arrangements within the air separation plant facility or enclave.

SUMMARY OF THE INVENTION

The present invention may be characterized as an argon producing air separation enclave comprising: (i) a first air separation unit having a first distillation column system configured to receive a first purified, cooled, and compressed feed air stream and to produce a first oxygen product stream, a first nitrogen stream, and a first argon rejection stream, and a first crude liquid argon stream; (ii) a second air separation unit having a second distillation column system configured to receive a second purified, cooled, and compressed feed air stream and to produce a second oxygen product stream, a second nitrogen stream, and an argon-oxygen rich vapor stream; and (iii) an argon superstaged or ultra-superstaged column arrangement having one or more argon columns, an argon condenser. The one or more argon columns are configured for receiving the argon-oxygen rich vapor stream from an intermediate location of a lower pressure column of the second distillation column system, a portion of the first crude liquid argon stream from the first air separation unit, and a reflux stream from the argon condenser. The argon condenser is configured to condense a first portion of the argon vapor stream to form the reflux stream via indirect heat exchange with a condensing stream taken from the first or second distillation column system.

The present invention may also be characterized as a method for producing argon in an air separation enclave, the method comprising the steps of: (a) producing a first oxygen product stream, a first nitrogen stream, a first argon rejection stream, and a first crude liquid argon stream from a first purified, cooled, and compressed feed air stream via fractional distillation in a first air separation unit having a first distillation column system; (b) producing a second oxygen product stream, a second nitrogen stream, and an argon-oxygen rich vapor stream from a second purified, cooled, and compressed feed air stream via fractional distillation in a second air separation unit having a second distillation column system; (c) directing the argon-oxygen rich vapor stream from the second distillation column system to a location proximate the bottom of an argon superstaged column; (d) directing a portion of the first crude liquid argon stream from the first air separation unit to an intermediate location of the argon superstaged column; (e) separating oxygen and argon in the argon superstaged column using an argon reflux stream to produce an argon overhead proximate the top of the argon superstaged column and a liquid oxygen at the bottom of the argon superstaged column; (f) condensing a first portion of the argon overhead via indirect heat exchange with a condensing stream taken from the second distillation column system or taken from the first distillation column system to form the argon reflux stream; (g) pumping the liquid oxygen from the argon superstaged column to an intermediate location of a lower pressure column of the second distillation column system; and (h) taking a second portion of the argon overhead stream as argon product.

In some preferred embodiments of the present system and method, additional air separation units may also be coupled or integrated with the first and second air separation units and configured to send a crude argon stream to the centralized argon superstaged or ultra-superstaged column arrangement. In addition, any of the distillation column systems of the first air separation unit, second air separation unit, or subsequent air separation units may be configured as a divided wall column arrangement having an argon-oxygen distillation column section and an oxygen-nitrogen distillation column section disposed within a shell of the lower pressure column of the second distillation column system. The argon condenser may also be disposed in the lower pressure column of second distillation column system at a location generally above the argon-oxygen distillation column section.

BRIEF DESCRIPTION OF THE DRAWINGS

While the specification concludes with claims distinctly pointing out the subject matter that Applicant regards as his invention, it is believed that the invention will be better understood when taken in connection with the accompanying drawings in which:

DETAILED DESCRIPTION

Figure 1:
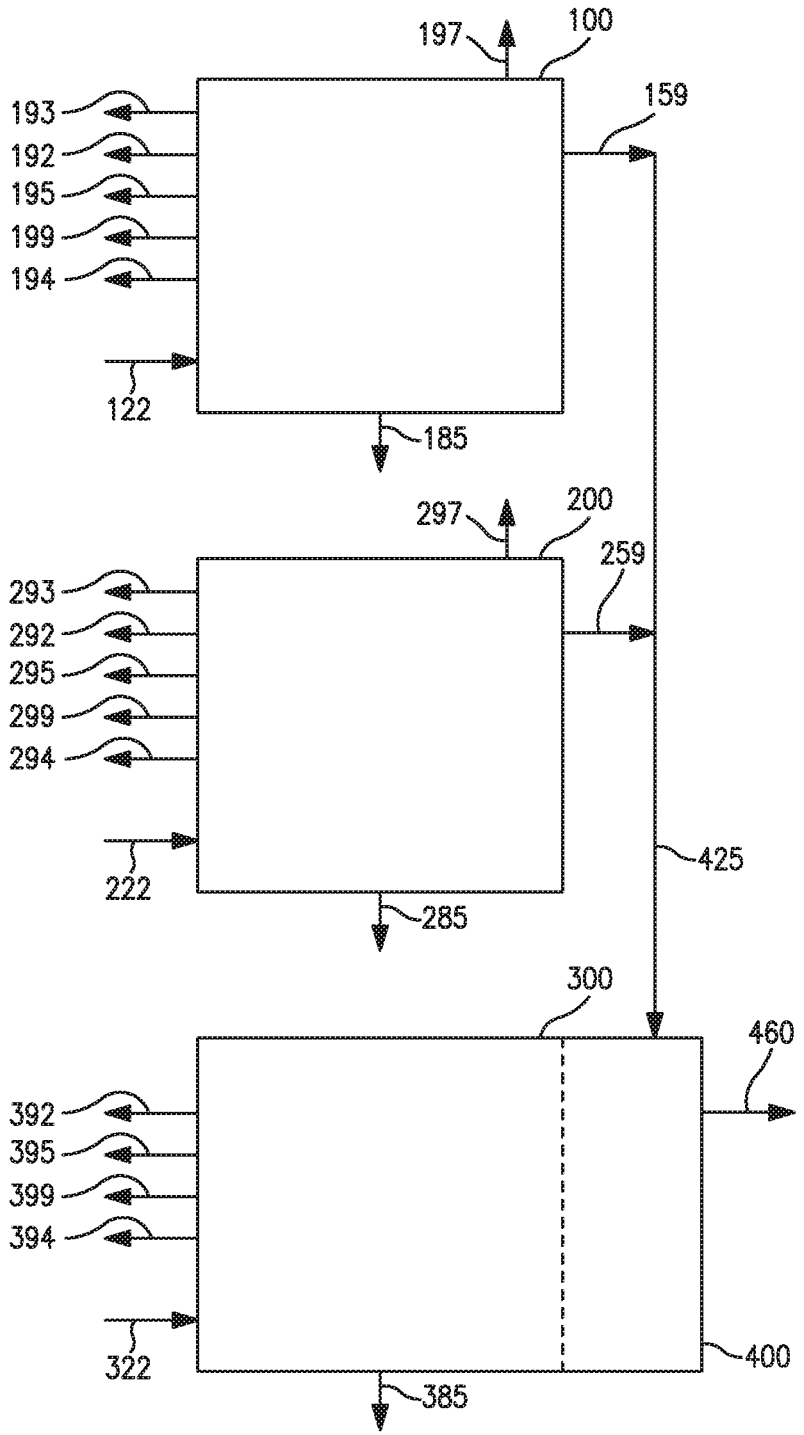
FIG. 1 is a schematic illustration of an air separation plant facility or enclave showing three air separation units in accordance with an embodiment of the present argon production system and method.

With reference to FIG. 1, an air separation plant facility or enclave is illustrated having a plurality of cryogenic air separation units, including a first cryogenic air separation unit 100, a second cryogenic air separation unit 200, and a third cryogenic air separation unit 300, as well as a centralized argon refining arrangement 400 that includes at least one argon superstaged column operatively coupled to at least one of the plurality of cryogenic air separation units 100, 200. Such large air separation plant facilities or enclaves may be suitable for large gasification projects where multiple gas products are needed. For example, large air separation plant facilities or enclaves often have a need for both high pressure gaseous nitrogen, typically at pressures >40 bara, and lower pressure, higher purity gaseous nitrogen, as well as various merchant products including liquid oxygen, liquid nitrogen and argon.

Air separation unit 100 is configured to receive an incoming feed air stream 122 and produce a plurality of product streams and/or waste streams that optionally include a gaseous oxygen stream 195, a liquid oxygen stream 185, a high pressure gaseous nitrogen product stream 199, a low pressure gaseous nitrogen product stream 192, a liquid nitrogen product stream 197, a nitrogen waste stream 194, an argon rejection stream 193, and a crude argon stream 159. Production of the streams is preferably achieved via use of a triple column fractional distillation process. Similarly, air separation unit 200 is configured to receive a second incoming feed air stream 222 and also produce a plurality of product streams and/or waste streams, optionally including a second gaseous oxygen stream 295, a second liquid oxygen stream 285, a second high pressure gaseous nitrogen product stream 299, a second low pressure gaseous nitrogen product stream 292, a second liquid nitrogen stream 297, a second nitrogen waste stream 294, a second argon rejection stream 293, and a second crude argon stream 259. As illustrated in FIG. 1, the first crude argon stream 159 and the second crude argon stream 259 are combined to form a combined crude argon stream 425.

Air separation unit 300 is configured to receive yet another or third incoming feed air stream 322 as well as the combined crude argon stream 425 and produce a plurality of product streams and/or waste streams optionally including, a third gaseous oxygen stream 395, a third liquid oxygen stream 385, a third high pressure gaseous nitrogen product stream 399, a third low pressure gaseous nitrogen product stream 392, a third nitrogen waste stream 394, and an argon product stream 460. Similar to the air separation units 100, 200, production of the streams from air separation unit 300 is preferably achieved via use of a fractional distillation process that preferably employs a double column or triple column distillation system together with a centralized argon column arrangement 400 that includes an argon superstaged or ultra-superstaged column and an argon condenser.

Figure 2:
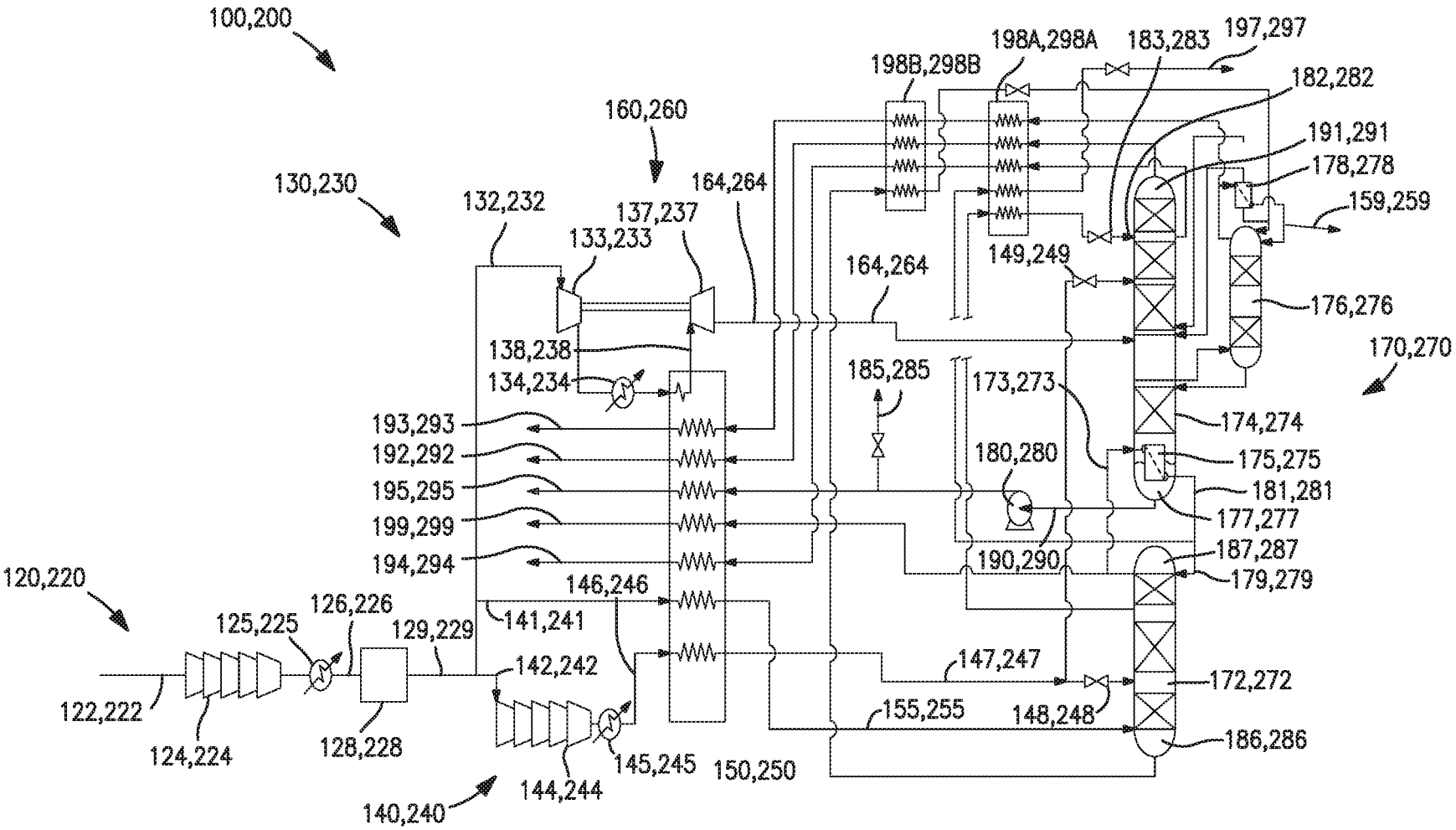
FIG. 2 is a schematic illustration of an air separation unit configured to produce a crude argon stream for use in the present argon production system and method.
Figure 3:
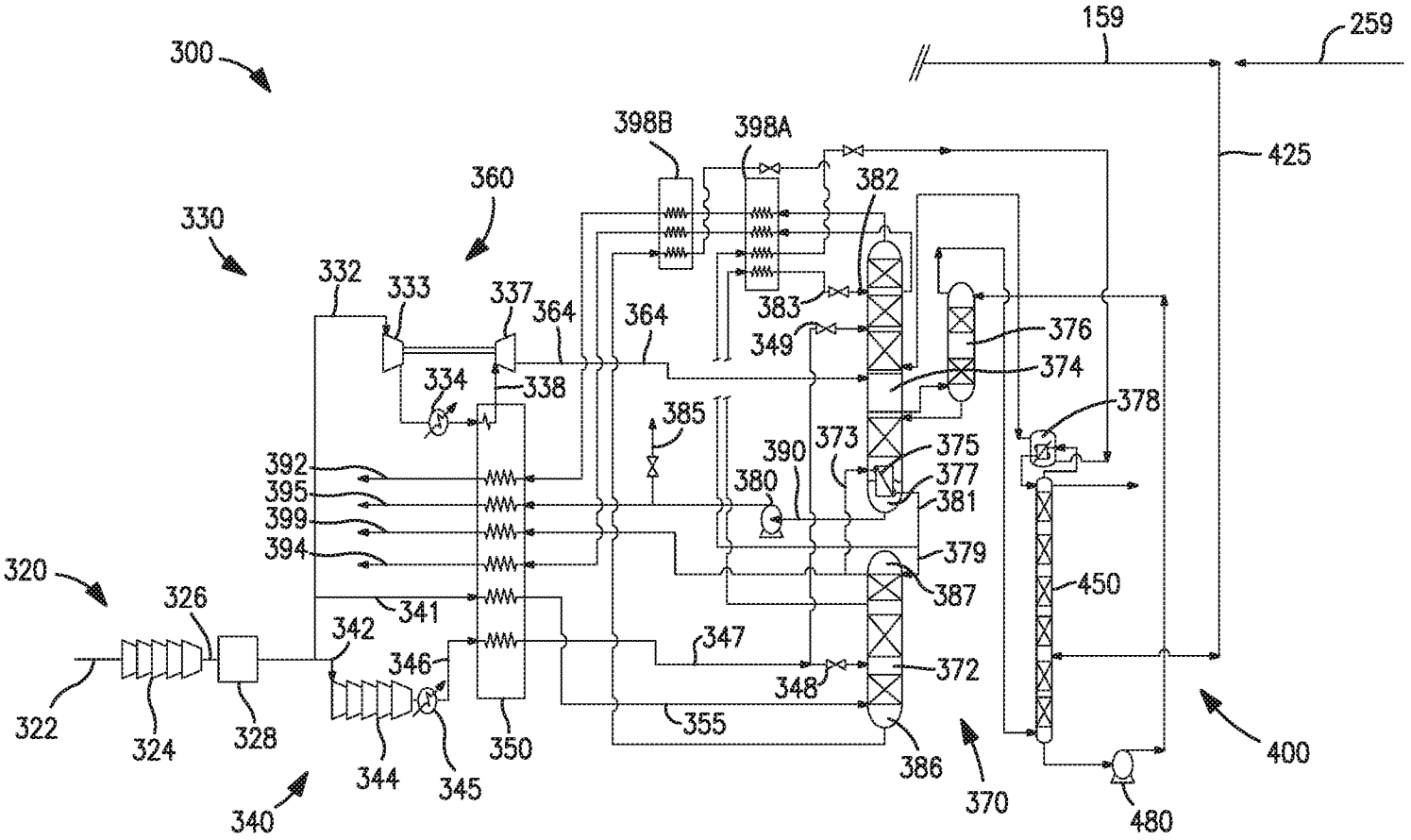
FIG. 3 is a schematic illustration of an air separation unit configured to receive crude argon streams and produce the argon product stream in the present argon production system and method.

FIG. 2 shows a more detailed schematic of an embodiment of air separation unit 100 and 200, while FIG. 3 shows a more detailed schematic of an embodiment of air separation unit 300 and the centralized argon column arrangement 400. In a broad sense, the depicted air separation units 100,200,300 each include: a main feed air compression train or system 120,220,320; a turbine air circuit 130,230,330; a booster air circuit 140,240,340; a main or primary heat exchanger 150,250,350; a turbine based refrigeration circuit 160,260,360; and a distillation column system 170,270,370. As used herein, the main feed air compression train, the turbine air circuit, and the booster air circuit, collectively comprise the 'warm-end' air compression circuit. Similarly, the main or primary heat exchanger, portions of the turbine based refrigeration circuit and portions of the distillation column system are referred to as the 'cold-end' systems/equipment that are typically housed in insulated cold boxes.

In the main feed compression train shown in FIGS. 2 and 3, the incoming feed air streams 122,222,322 are typically drawn through an air suction filter house and compressed in a multi-stage, intercooled main air compressor arrangement 124,224,324 to a pressure that can be between about 5 bar(a) and about 15 bar(a). This main air compressor arrangements 124,224,324 may include integrally geared compressor stages or a direct drive compressor stages, arranged in series or in parallel. The compressed air streams exiting the respective main air compressor arrangements 124,224,324 is fed to an aftercooler 125,225,325 or with integral demister to remove the free moisture in the incoming feed air stream. The heat of compression from the final stages of compression for each of the main air compressor arrangements 124,224,324 is removed in aftercoolers by cooling the compressed feed air with cooling tower water. The condensate from this aftercooler as well as some of the intercoolers in the main air compression arrangements 124,224,324 are preferably piped to a condensate tank and used to supply water to other portions of the air separation plant facility or enclave.

The cool, dry compressed air feed 126,226,326 is then purified in a pre-purification unit 128,228,328 to remove high boiling contaminants from the cool, dry compressed air feed. The pre-purification units 128,228,328, as is well known in the art, typically contains two beds or more of alumina and/or molecular sieve operating in accordance with a temperature and/or pressure swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste nitrogen from the air separation unit. The two beds switch service periodically. Particulates are subsequently removed from the compressed, pre-purified feed air in a dust filter disposed downstream of the pre-purification unit 128,228,328 to produce the compressed, purified air streams 129,229,329.

The compressed and purified air streams 129,229,329 are separated into oxygen-rich, nitrogen-rich, and argon-rich fractions in a plurality of distillation columns including a higher pressure column 172,272,372; a lower pressure column 174,274,374; and an argon column arrangement, which may include an argon rejection column 176, 276 configured to receive an argon-oxygen rich vapor stream from an intermediate location of the lower pressure column and/or an argon superstaged column 450. Prior to such distillation however, the compressed and pre-purified air streams 129, 229,329 are typically split into a plurality of feed air streams, which includes a boiler air stream 142,242,342, a turbine air stream 132,232,332, and a third air stream 141,241, 341.

The boiler air stream and third air stream together comprised generally between about 25% to 45% of the compressed and purified feed air stream. The boiler air streams 142,242,342 may be further compressed in a booster compressor arrangement 144,244,344 to a targeted pressure between about 25 bar(a) and about 70 bar(a) and subsequently cooled in aftercooler 145,245,345 to form a boosted pressure air stream 146,246,346. The target pressure of the boosted pressure air streams 146,246,346 are generally dictated by the product requirements for the high pressure gaseous oxygen product streams. Each of the boosted pressure air streams 146,246,346 are then further cooled to temperatures required for rectification in the associated main heat exchanger 150,250,350 where it is used to boil liquid oxygen streams via indirect heat exchange to produce high pressure gaseous oxygen product streams. The temperature of the cooled and further compressed boiler air streams 147,247,347 exiting main heat exchangers is preferably between about 96 Kelvin and about 100 Kelvin which represents a cold-end temperature of main heat exchangers.

The turbine air streams 132,232,332 are generally about 55% to 75% of the compressed and purified feed air streams and are optionally further compressed in one or more turbine air compressors 133,233,333, cooled in aftercoolers 134, 234,334 and directed as stream to the main heat exchangers 150,250,350 where it is partially cooled prior to being directed to the turbine based refrigeration circuit 160,260, 360, as described below. The target pressure of the further compressed turbine air stream is preferably between about 20 bar(a) and about 60 bar(a).

The partially cooled feed air streams 138,238,338 are expanded in the respective turboexpander 137,237,337 in the turbine based refrigeration circuit 160,260,360 to produce feed air streams 164,264,364 that are directed to the lower pressure column 174,274,374 in each of the respective air separation units 100,200,300. Refrigeration for each of the air separation units 100,200,300 is also typically generated by the associated turbine based refrigeration circuits 160,260,360 and other associated cold and/or warm turbine arrangements, such as closed loop warm refrigeration circuits, as generally known in the art.

The fully cooled boosted pressure air streams 147,247, 347 are each divided into separate portions which are expanded in expansion valve(s) 148,149, 248,249, 348,349 or in a liquid turbine prior to introduction into higher pressure column and lower pressure column for each of the air separation units. Lastly, a third air stream 141,241,341 comprising a portion of the compressed, purified feed air 129,229,329 may be directed to the main or primary heat exchangers 150,250,350 where they are fully cooled to temperatures suitable for rectification as streams 155,255, 355 and that are subsequently introduced into the higher pressure columns 172,272,372.

In some embodiments of the present system, liquid production in the cryogenic air separation units, including a pressurized liquid oxygen product stream and a liquid nitrogen product stream, may be further varied by varying the pressure in the turbine air stream sent to the turboexpander. This variation in pressure can be effectuated by a turbine air stream bypass circuit (not shown) which includes a bypass line having a bypass valve that can be set in an open or closed position.

The bypass circuit is configured to direct all or a portion of the turbine air stream to bypass at least one of the one or more turbine air compressors. If a bypass circuit is employed, the target pressure of the bypassed turbine air stream is preferably between about 10 bar(a) and about 30 bar(a). Also, in some embodiments that utilize the bypass circuit, it may be advantageous to provide a source of make-up nitrogen that is directed to the turbine air stream compressors in lieu of the turbine air stream so as to not damage the turbine air compressor.

The main or primary heat exchangers 150, 250,350 are preferably brazed aluminum plate-fin type heat exchangers. Such heat exchangers are advantageous due to their compact design, high heat transfer rates and their ability to process multiple streams. They are manufactured as fully brazed and welded pressure vessels. For small air separation unit units, a heat exchanger comprising a single core may be sufficient. For larger air separation unit units handling higher air flows, the main heat exchanger may be constructed from several heat exchange cores which may be connected in parallel or series.

The components of the feed air streams, namely oxygen, nitrogen, and argon are separated within the distillation column systems 170,270,370 that preferably includes two or more distillation columns in which vapor and liquid are counter-currently contacted in order to produce a gas/liquid mass-transfer based separation of the respective feed streams. Such columns will preferably employ structured packing or trays as the mass transfer contacting elements.

Each of the distillation column systems 170,270,370 shown in FIGS. 2 and 3 include: a higher pressure column 172,272,372; a lower pressure column 174,274,374; a main condenser-reboiler 175,275,375; and an argon column arrangement. The illustrated argon column arrangements in FIG. 2 preferably are configured as an argon rejection column 176, 276 as well as argon condenser 178,278,478. The illustrated argon column arrangements in FIG. 3 preferably is an argon rejection column 376 and an argon superstaged column 450 as well as argon condenser 478. The higher pressure columns typically operate in the range from between about 20 bar(a) to about 60 bar(a) whereas the lower pressure columns operate at pressures between about 1.1 bar(a) to about 1.5 bar(a).

The higher pressure columns and the lower pressure columns for each air separation units are preferably inked in a heat transfer relationship such that a portion of the nitrogen-rich vapor column overhead, extracted from proximate the top of higher pressure columns 172,272,372 as a stream 173,273,373 is condensed within the condenser-reboiler 175,275,375 typically located in the base of lower pressure columns 174,274,374 against boiling an oxygen-rich liquid column bottoms 177,277,377. The boiling of oxygen-rich liquid column bottoms initiates the formation of an ascending vapor phase within lower pressure columns 174,274, 374. The condensation produces a liquid nitrogen rich stream in each of the air separation units that may be divided into a reflux streams that refluxes one or more of the distillation columns to initiate the formation of the descending liquid phase and optionally taken a liquid nitrogen stream 197,297. Also, a portion of the nitrogen-rich vapor column overheads may be taken and warmed in the main or primary heat exchangers 150,250,350 to produce the high pressure gaseous nitrogen streams 199,299,399. The reflux streams 179,279,379 directed to the higher pressure columns 172,272,372 are preferably a portion of the nitrogen-rich liquid streams 181,281,381 exiting the main condenser-reboiler 175,275,375. Another portion of the nitrogen-rich liquid streams 181,281,381 exiting the main condenser-reboilers 175,275,375 may be subcooled and taken as a liquid nitrogen product stream 197, 297.

The fully cooled air streams 155,255 together with all or a portion the further compressed and cooled boosted air streams 147,247,347 are introduced into the higher pressure column for distillation by contacting an ascending vapor phase of such mixture within a plurality of mass transfer contacting elements (which may be trays or structured packing), with a descending liquid phase that is initiated by the reflux streams. This distillation process produces crude liquid oxygen column bottoms 186,286,386 also known as kettle liquid, and the nitrogen-rich column overhead 187, 287,387.

In the illustrated embodiments, the exhaust streams 164, 264,364 from each of the turbine air refrigeration circuits 160,260,360 are introduced into the associated lower pressure column along with a portion of the further compressed and cooled boosted air streams 147,247,347 for distillation. Distillation within the lower pressure column is achieved using a plurality of mass transfer contacting elements, that can be trays, structured packing or other known elements in the art of cryogenic air separation. As stated previously, the separation occurring within lower pressure column produces an oxygen-rich liquid column bottoms 177,277,377 extracted as an oxygen-rich liquid stream 190,290,390 and a nitrogen-rich vapor column overhead 191,291,391 that are extracted as a low pressure nitrogen product stream 192, 292,392.

As shown in the drawings, the oxygen-rich liquid stream 190,290,390 may be pumped via pumps 180,280,380 and taken as a pumped liquid oxygen product 185,285,385 or directed to the associated main heat exchangers where the pumped oxygen stream is warmed to produce a gaseous oxygen product stream 195,295,395. Additionally, nitrogen waste streams 194,294,394 may also be extracted from the lower pressure columns to control the purity of the low pressure nitrogen product streams 192,292,392.

The low pressure nitrogen product streams, nitrogen waste streams, and argon rejection streams are preferably passed through one or more subcooling units 198A/B, 298A/B, and 398A/B designed to subcool: (i) the liquid nitrogen product stream 197,297; (ii) the respective kettle streams 186,286 used to reflux the argon column 176,276; and (iii) a shelf nitrogen reflux streams 182,282,382 used to reflux the lower pressure columns in each of the air separation units. As shown in FIGS. 2 and 3, the subcooled shelf nitrogen reflux streams 182,282,382 are preferably introduced into lower pressure column after passing through expansion valves 183,283,383. After passage through subcooling units, the low pressure nitrogen product streams, nitrogen waste streams, and argon rejection streams are fully warmed within the respective main or primary heat exchangers 150,250,350 to produce warmed nitrogen product streams, warmed nitrogen waste streams and warmed argon rejection streams. Although not shown, the warmed nitrogen waste streams may be used to regenerate the adsorbents within the pre-purification units.

Divided Wall Argon Rejection Column

Figure 4:
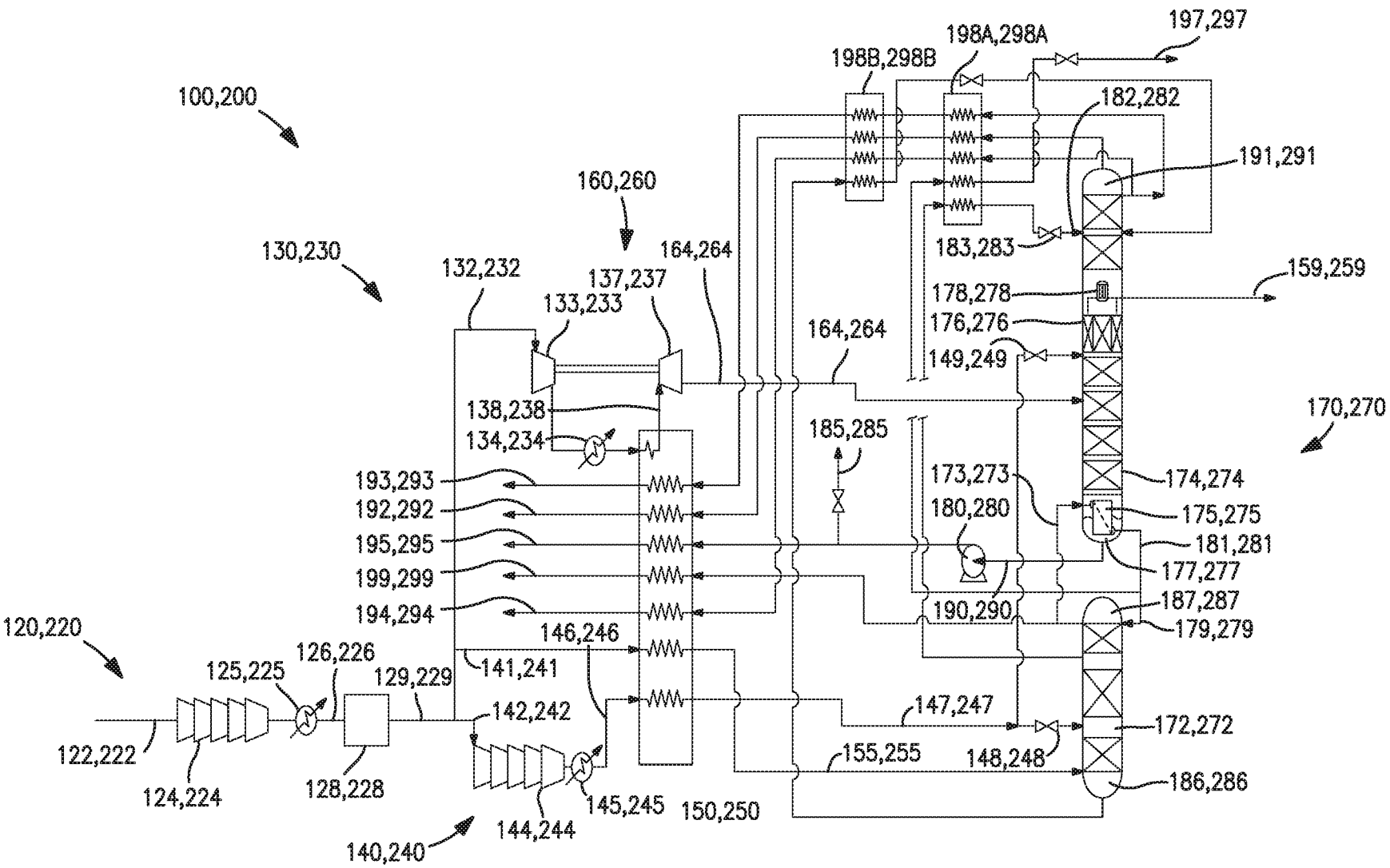
FIG. 4 is a schematic illustration of an alternate embodiment of the air separation unit configured to produce the crude argon stream for use in the present argon production system and method.
Figure 5:
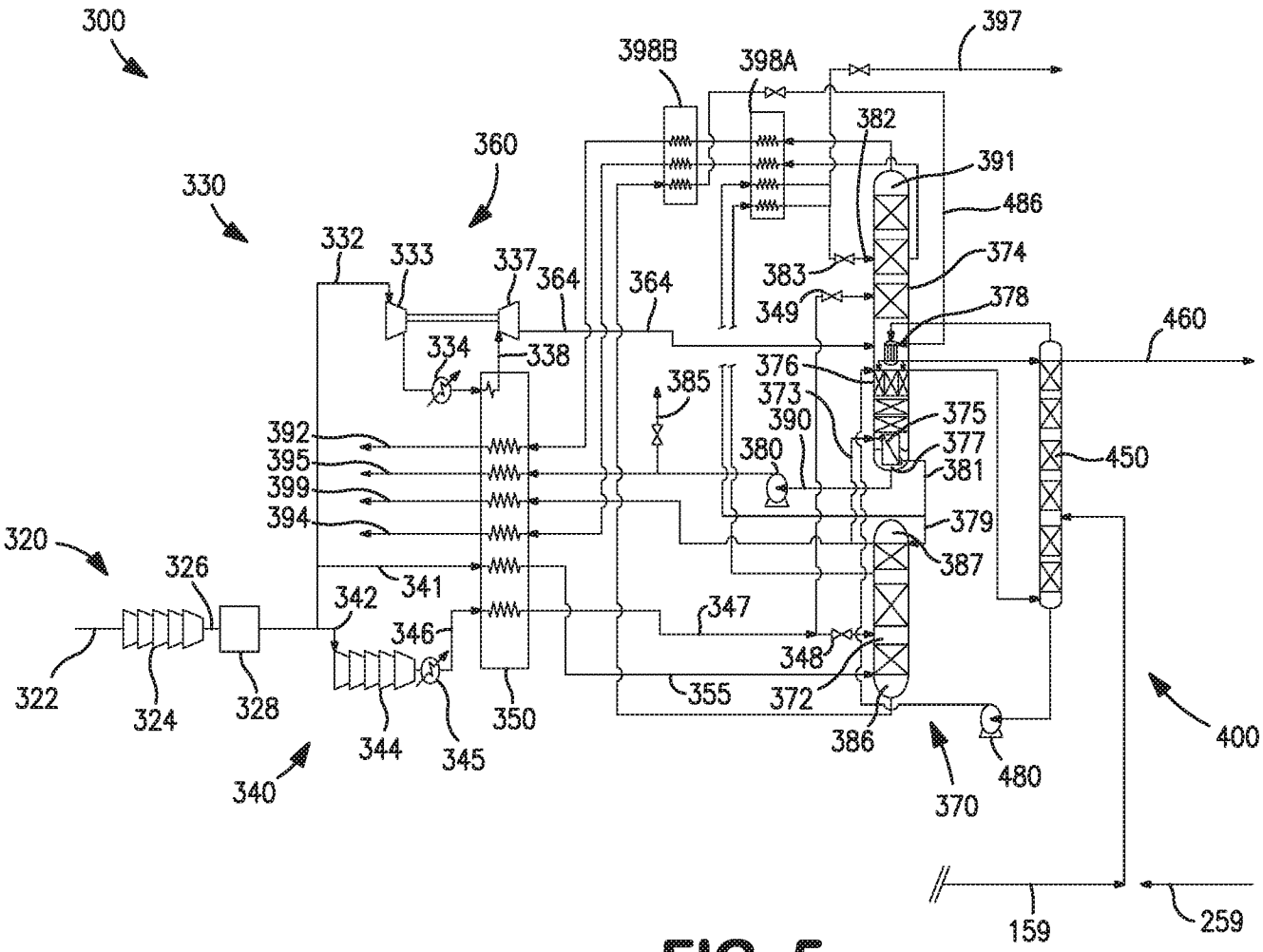
FIG. 5 is a schematic illustration of an alternate embodiment of the air separation unit configured to receive crude argon streams and produce the argon product stream in the present argon production system and method.

Employing a divided wall argon rejection column arrangement and argon condenser within the shell of the lower pressure column of a cryogenic air separation unit, as generally depicted in FIGS. 4 and 5, can enable significant capital cost reductions for the air separation plant facility as well as yield some power savings and may also serve to increase the oxygen recovery within the individual cryogenic air separation units.

An alternate embodiment of the air separation unit configured to produce the crude argon stream for use in the present argon production system and method is depicted in FIG. 4 whereas an alternate embodiment of the air separation unit configured to receive crude argon streams and produce the argon product stream in the present argon production system and method is depicted in FIG. 5. Since many of the elements, features and reference numerals of the embodiments of the air separation units shown in FIGS. 4 and 5 are the same or similar to those in FIGS. 2 and 3 respectively, the detailed descriptions will not be repeated. However, the differences in the features and elements between the embodiments shown in FIGS. 2 and 3 and the embodiment shown in FIGS. 4 and 5 are broadly described in the paragraphs that follow. The key differences rest in the arrangement or configuration of the argon rejection column and argon condensers in the air separation units as well as the centralized argon arrangement.

For example, in FIG. 3, the centralized argon column arrangement is depicted as an argon ultra-superstaged column arrangement including a low ratio column operatively coupled with a superstaged argon column whereas in FIG. 5, the argon column arrangement is shown as an argon superstaged column and a downstream high-ratio column. In addition, FIG. 2 and FIG. 3 shows the argon rejection column in the air separation units as an external crude argon column having an external argon condenser whereas in FIG. 4 and FIG. 5, the argon rejection column is disposed within the lower pressure column shell and is configured as an annular divided wall column. Also, in the embodiment of FIG. 4, the argon condenser is also disposed internally within the lower pressure column shell at a location above the argon rejection section.

With reference again to FIGS. 4 and 5, within the footprint of the lower pressure column structure, an intermediate portion of the column structure preferably contains a divided wall column arrangement having a main distillation section and a partitioned argon rejection section. In the illustrated embodiments, the partitioned argon rejection section is an argon rejection column 176,276 configured to separate argon and oxygen using an oxygen-rich ascending vapor stream and an argon-rich reflux stream. The main distillation section is configured as a portion of the lower pressure distillation column and is configured to separate oxygen and nitrogen using a nitrogen rich ascending vapor stream (i.e. air) and an oxygen-rich reflux stream. It has been found that for certain air separation plants, and in particular many gas only oxygen plants, an argon rejection column can enable large power savings and serves to increase oxygen recovery. As discussed above, in many cases a separate argon rejection column involves high capital costs. This is especially true in larger plants that would require an additional or enlarged cold box package to accommodate the separate argon rejection column.

The additional capital cost typically associated with a separate argon rejection column is greatly reduced if, as contemplated in the present embodiments, the argon rejection column 176,276 is combined with and disposed within the lower pressure column structure as a divided wall column arrangement. It is important to note that in many conventional cryogenic air separation units, a defined section of the lower pressure column is typically under-utilized or unloaded because some of the vapor is "bypassed" to the external argon superstaged column so that the flow area of this underutilized or unloaded section of the lower pressure column required for distillation can be reduced and somewhat less than the flow area for the remainder of the lower pressure column sections. As a result, an argon rejection column can preferably be co-located in this under-utilized or unloaded section of the lower pressure column structure by designing a divided wall column having a main distillation section and a partitioned argon rejection section at this location of the lower pressure column structure. In such arrangement, a portion of the vapor from the adjacent section of the lower pressure column immediately below the divided wall column flows to the partitioned argon rejection section while the remaining portion of the vapor from the adjacent section of the lower pressure column immediately below the divided wall column arrangement ascends upward through to main distillation section.

The divided wall argon rejection column disposed within the lower pressure column structure operates at a pressure comparable to the pressure within the lower pressure column. The partitioned argon rejection section receives an upward flowing argon and oxygen containing vapor feed from the lower pressure column, typically having a concentration of about 8% to 15% by volume argon, and a downflowing argon rich reflux received from an argon condenser. The partitioned argon rejection section serves to rectify the argon and oxygen containing vapor feed by separating argon from the oxygen into an argon enriched overhead vapor stream and an oxygen-rich liquid stream that that is released or returned into the lower pressure column at a point below the divided wall column arrangement. The mass transfer contacting elements within the divided wall argon rejection column arrangement could be trays or other packing.

The resulting argon-rich vapor overhead stream is then preferably directed to the argon condenser also preferably disposed within the structure of the lower pressure column where all or a portion of the argon-rich vapor overhead stream is condensed into a crude liquid argon stream. A first portion of the crude liquid argon stream is used as an argon-rich reflux stream for the partitioned argon rejection section and the remaining portion of the crude liquid argon is directed to an argon superstaged column 450 that is operatively coupled to air separation unit 300. In the depicted embodiments, the argon-rich reflux stream is directed back to the uppermost portion of the partitioned section and initiates the descending argon liquid phase that contacts the ascending argon and oxygen containing vapor feed. In some embodiments, a portion of the argon-rich vapor overhead stream may be diverted and directed to the main heat exchanger 40 recover refrigeration or the portion of the argon-rich vapor overhead stream can be simply rejected as a waste stream.

In the illustrated embodiments, the height of the partitioned argon rejection section is preferably limited to accommodate between about 15 and 40 stages of separation, and more preferably between 20 and 30 stages of separation. While such limited number of separation stages is sufficient for argon rejection needed to improve the oxygen recovery of the cryogenic air separation unit, the resulting purity of the argon rejection vapor stream exiting the partitioned argon rejection section is relatively low at about 4% to 25% oxygen, and more preferably between 10% and 15% oxygen, with up to 1% nitrogen impurities.

The argon condenser is preferably configured as a once-through argon condenser and is disposed internal to the lower pressure column, just above the divided wall arrangement of the lower pressure column structure that forms the argon rejection column. This location of the argon condenser is the natural feed point for the kettle liquid and vapor, and the natural point to condense the argon overhead vapor. As a result, this location is an ideal location to house the argon condenser to minimize piping and avoiding the need for a separator vessel for the two phase partially boiled kettle stream. Alternatively, the argon condenser may be disposed externally from the lower pressure column or at the uppermost portion of lower pressure column, although additional piping may be required.

It should be noted that the air separation plant facility or enclave can utilize multiple cryogenic air separation units of different types and the different air separation units need not be configured to duplicate the air separation cycles or processes. For instance, one cryogenic air separation unit can be designed to deliver a high pressure, high purity nitrogen stream while another cryogenic air separation unit may be designed for only oxygen production.

While the argon production systems and methods have been described with reference to a preferred embodiment as will occur to those skilled in the art, numerous changes and additions and omissions can be made without departing from the spirit and the scope of the present invention as set forth in the appended claims.

What is claimed is:

1. An argon producing air separation enclave comprising:

a first air separation unit having a first distillation column system configured to receive a first purified, cooled, and compressed feed air stream and to produce a first oxygen product stream, a first nitrogen stream, a first argon rejection stream, and a first crude liquid argon stream;

a second air separation unit having a second distillation column system configured to receive a second purified, cooled, and compressed feed air stream and to produce a second oxygen product stream, a second nitrogen stream, and an argon-oxygen rich vapor stream;

an argon column arrangement comprising an argon superstaged column or argon ultra-superstaged column, and an argon condenser;

wherein the argon column arrangement is configured for receiving the argon-oxygen rich vapor stream from an intermediate location of a lower pressure column of the second distillation column system at a location proximate the bottom of the argon superstaged column or argon ultra-superstaged column, a portion of the first crude liquid argon stream from the first air separation unit at an intermediate location of the argon superstaged column or argon ultra-superstaged column, and a reflux stream from the argon condenser, the argon superstaged column or argon ultra-superstaged column are further configured to produce an argon rich vapor stream proximate the top of the argon superstaged column or argon ultra-superstaged column and liquid oxygen stream proximate the bottom of the argon superstaged column or argon ultra-superstaged column;

wherein the argon condenser is configured to condense a first portion of the argon vapor stream to form the reflux stream via indirect heat exchange with a condensing stream taken from the second distillation column system or taken from the first distillation column system;

wherein the liquid oxygen stream is pumped to the lower pressure column of the second distillation column system; and wherein a second portion of the argon vapor stream is taken as an argon product stream if the argon column arrangement includes an argon ultra-superstaged column arrangement or taken as an argon-nitrogen stream to be further refined in a high ratio column if the argon column arrangement includes an argon superstaged column.

2. The argon producing air separation enclave of claim 1 wherein the second distillation column system further comprises a divided wall column arrangement having an argon-oxygen distillation column section and an oxygen-nitrogen distillation column section disposed within a shell of the lower pressure column of the second distillation column system.

3. The argon producing air separation enclave of claim 2 wherein the argon condenser is disposed in the lower pressure column of second distillation column system at a location above the argon-oxygen distillation column section.

4. The argon producing air separation enclave of claim 1 wherein the first distillation column system further comprises a divided wall column arrangement having an argon-oxygen distillation column section and an oxygen-nitrogen distillation column section disposed within a shell of the lower pressure column of the first distillation column system.

5. The argon producing air separation enclave of claim 4 wherein the first distillation column system further comprises an argon condenser disposed in the lower pressure column of first distillation column system at a location above the argon-oxygen distillation column section and wherein a first portion of the ascending argon-rich vapor in the argon-oxygen distillation column section is condensed in the argon condenser against an oxygen-rich stream from within the first distillation column system and a second portion of the ascending argon-rich vapor in the argon-oxygen distillation column section forms the argon rejection stream.

6. The argon producing air separation enclave of claim 1 further comprising a third air separation unit having a third distillation column system configured to receive a third purified, cooled, and compressed feed air stream and to produce a third oxygen product stream, a third nitrogen stream, a third argon rejection stream, and a second crude liquid argon stream and wherein a portion of the second crude liquid argon stream is also introduced to the argon superstaged column or the argon ultra superstaged column.

7. The argon producing air separation enclave of claim 6 wherein the third distillation column system further comprises a divided wall column arrangement having an argon-oxygen distillation column section and an oxygen-nitrogen distillation column section disposed within a shell of the lower pressure column of the third distillation column system.

8. The argon producing air separation enclave of claim 7 wherein a third argon condenser is disposed in the lower pressure column of third distillation column system at a location above the argon-oxygen distillation column section and wherein a first portion of the ascending argon-rich vapor in the argon-oxygen distillation column section of the third distillation column system is condensed in the third argon condenser against an oxygen-rich stream from within the third distillation column system and a second portion of the ascending argon-rich vapor in the argon-oxygen distillation column section of the third distillation column system forms the third argon rejection stream.

9. The argon producing air separation enclave of claim 8 wherein the first distillation column system is the same design as the third distillation column system.

* * * * *